US005595299A

United States Patent [19]

Le Bras

[11] Patent Number: 5,595,299

[45] Date of Patent: Jan. 21, 1997

[54] BOTTLE CARRIER WITH RETAINING MEANS

[75] Inventor: Philippe Le Bras, Chateauroux, France

[73] Assignee: The Mead Corporation, Dayton, Ohio

[21] Appl. No.: 446,766

[22] PCT Filed: Apr. 22, 1994

[86] PCT No.: PCT/US94/04429

§ 371 Date: Jun. 2, 1995

§ 102(e) Date: Jun. 2, 1995

[87] PCT Pub. No.: WO94/25363

PCT Pub. Date: Nov. 10, 1994

[30] Foreign Application Priority Data

Apr. 30, 1993 [GB] United Kingdom ..... 9309048

[51] Int. Cl.[6] ..... B65D 75/00

[52] U.S. Cl. ..... 206/434; 206/148

[58] Field of Search ..... 206/147–149, 206/158, 168, 194, 197, 140, 434

[56] References Cited

U.S. PATENT DOCUMENTS

| | | | |
|---|---|---|---|
| 3,128,034 | 4/1964 | Weiss | 206/140 |
| 3,142,378 | 7/1964 | Lengsfield, Jr. . | |
| 3,495,704 | 2/1970 | Richards et al. | 206/196 |
| 3,517,876 | 6/1970 | Stout | 206/149 |
| 3,528,697 | 9/1970 | Wood | 294/87.2 |
| 4,373,630 | 2/1983 | Oliff | 206/434 |
| 4,382,505 | 5/1983 | Sutherland et al. | 206/180 |

FOREIGN PATENT DOCUMENTS

| | | |
|---|---|---|
| 0030322 | 6/1981 | European Pat. Off. . |
| 0059104 | 9/1982 | European Pat. Off. . |
| 0171229 | 2/1986 | European Pat. Off. . |
| 0170490 | 5/1986 | European Pat. Off. . |
| 0247298 | 12/1987 | European Pat. Off. . |
| 2647755 | 12/1990 | France . |
| 2093434 | 9/1982 | United Kingdom . |

*Primary Examiner*—Bryon P. Gehman
*Attorney, Agent, or Firm*—Thomas A. Boshinski

[57] ABSTRACT

An article carrier has a plurality of interconnected panels, including a side wall panel and a second wall panel which are foldably interconnected. Article receiving and retention in the carrier along the side wall panel and second wall panel is provided by an aperture adapted to receive a portion of an article contained within the carrier, and a flap struck from and hingaably connected to an edge of the aperture, which flap is adapted to abut the article received in the aperture. The flap is pivotal into an operative position about its hinged connection inwardly of the carrier to provide portions thereof which protrude both inwardly and outwardly of the carrier so that a portion of the flap engages the article internally of the carrier and another portion of the flap engages the article externally of the carrier.

19 Claims, 2 Drawing Sheets

BOTTLE CARRIER WITH RETAINING MEANS

This invention relates to article carriers and blanks therefor which are particularly useful for carrying articles such as bottles. More particularly the invention relates to a bottle carrier of the wrap-round type and is concerned with an improved bottle retention and carrier reinforcing feature which receive heel portions of bottles accommodated in the carrier.

Bottle heel retention means in wraparound carriers are well known.

EPO171229B1 discloses a known bottle carrier of the wrap-around type having top, bottom and side walls interconnected to form a tubular open-ended structure. A sloping heel panel interconnects each side wall along a fold line with an associated bottom lap panel. The bottom corners of the carton formed by the sloping heel panel comprise bottle heel receiving apertures formed in each sloping heel panel which extend into the associated side wall and lap panels. The receiving apertures form part of the bottle heel retaining feature which further comprises bottle engaging and carrier reinforcing flaps which are foldably joined along opposed peripheral edges of the bottle heel receiving apertures. In particular, EPO171229B1 discloses bottle engaging and carrier reinforcing flaps which extend across the associated sloping heel panel and into the associated side wall and lap panel; the flaps comprising hinged portions so that in the formed bottle carrier a portion of the bottle engaging and carrier reinforcing flap is substantially parallel with the inner surface of the associated lap panel. In this construction a portion of the heel of a bottle protrudes from the carrier without being protected and the tighter the package is made the more is the tendency for the heel to protrude further. Also, tears can be created in the carton surrounding a receiving aperture due sometimes to an "over tight" package and in part at least, to any movement of a bottle acting directly against the edge of the receiving aperture.

Another type of bottle heel retaining structure is shown by EPO 059 104. This reference discloses a heel retaining flap extending primarily outwardly of the carton, although C-shaped cuts provided cause a small portion of the flap to extend inwardly of the carton. However the folding action of the retaining flaps is outward i.e. the pivoting action is outward and not inward. EPO 247 298 is another example of an outwardly extending bottle heel retaining flap and whereas in practice a small portion of the flap may extend inwardly of the carton, the setting up pivoting action is outward.

One aspect of the invention provides an article carrier for bottles comprising angularly related panels such as a top, bottom and side wall panels which are foldably interconnected. Accordingly the carrier might be of the tray or wraparound types for example. The carrier further comprises article receiving and retaining means extending between a main side wall panel and a main second panel which is either a top or a bottom panel, said means comprising an aperture adapted to receive a portion of an article contained within the carrier, and a flap struck from and hingably connected to an edge of said aperture which flap is adapted to abut the article received in the aperture, and wherein the flap is pivotal into an operative position about its hinged connection to provide portions thereof which protrude both inwardly and outwardly of the carrier so that a portion of said flap engages the article internally of the carrier and another portion of said flap engages the article externally of the carrier, said flap being put into its operative position by pivoting inwardly of the carrier.

Beneficially, a retaining means might be provided to retain a heel or a shoulder, or both, of an article such as a bottle or a can for example.

According to a feature of this aspect of the invention said receiving and retaining means may comprise a pair of complimentary hinged flaps, each being hinged on opposite edges of said aperture.

According to another feature of this aspect of the invention, said other portion of the or each flap may be defined at least in part by a cut line extending between a pair of spaced hinged connections about which the flap is pivotal out of the plane of said aperture.

Preferably, said other flap portion is disposed laterally beyond an imaginary straight line taken between adjacent ends of the hinged connections. Moreover the other flap portion might be defined by said straight line and said cut line extending between the spaced hinged connections.

According to yet another feature of this aspect of the invention, the carrier may further comprise an inclined panel which foldably connects together a side panel and the second wall panel of the carrier and wherein said aperture is struck partially from each of said side panels, said inclined panel and said second wall panel. In some constructions where this feature is adopted said cut line may be formed in said inclined panel between the first and second hinges of the flap which hinges are formed in the side and second wall panels respectively. In other constructions where this feature is adopted said cut line may be formed partially in said inclined panel and partially in said second wall panel between the first and second hinges which hinges are formed at least partially in said side panel and in said second wall panel respectively. Preferably, the cut between the first and second hinges of the flaps is substantially arcuate.

According to yet another feature of this aspect of the invention each of said flaps may include an upper portion and a lower portion hinged so as to be foldable relative to one another and thereby allow the flap to bend and better conform to the shape of a bottle heel portion and wherein the hinged connection between said upper and lower flap portions is disposed above the base of a bottle engaged therewith.

According to a still further feature of the invention an article carrier receiving means may be provided to receive each of the outermost corner articles contained in the carrier.

Another aspect of the invention provides an article carrier of the wraparound type having top, bottom and side walls interconnected to form a tubular open-ended structure, a sloping heel panel interconnected with each side wall along a fold line and an associated bottom lap panel along a fold line and article heel receiving and retaining means comprising apertures formed in each sloping heel panel which extend into the associated side wall and bottom lap panel, said receiving means including article engaging and carrier reinforcing flaps which are foldably joined to said lap panel and said side wall panel, said flaps having fold lines formed therein which allow the flaps to conform to the configuration of the article and wherein, in the formed carrier, the flaps are folded substantially inwardly but also provide an outwardly extending portion which abuts that part of the article protruding through the associated receiving aperture.

Another aspect of the invention provides an article receiving and retaining means for an article carrier struck from corner panels in adjacent walls of the carrier, which means comprises an aperture within the corner panels and a flap struck from and hingably connected to an edge of the aperture which flap is adapted to pivot into an operative position about its hinge to provide portions thereof which extend both inwardly and outwardly of the carrier, both inwardly and outwardly extending portions being adapted to engage respective parts of an article retained in the means in use, said flap being adapted to be put into said operative position by pivoting said operatively inwardly extending flap portion inwardly. In a preferred form of the article receiving and retaining means the flap comprises a series of foldably interconnected flap portions, at least one portion of which is adapted at least partially to engage an end of an article in use and at least an adjacent flap portion is adapted to engage a side of an article in use, wherein the fold line between the one and adjacent flap portions is disposed adjacent the side of the article in use.

Another aspect of the invention provides a blank comprising side wall panels and a second wall panel such as a bottom or top wall panel which are foldably interconnected, article receiving and retaining means extending between a side wall panel and said second wall panel, said means comprising an aperture adapted to receive a portion of an article in use and a flap struck from and hingably connected to an edge of said aperture which flap is adapted to abut the article received in the aperture in use and wherein the flap is adapted to pivot into an operative position about its hinged connection to provide portions thereof which extend both inwardly and outwardly through the aperture in use, a portion of said flap being adapted to engage part of an article internally of a carrier formed from the blank and another portion of said flap being adapted to engage part of the article externally of the carrier, said flap being adapted to be put into its operative position by pivoting inwardly of the carrier.

In a preferred form of the blank the side wall panel comprises a side panel and an inclined panel which inclined panel foldably connects together the side panel and the second wall panel, and wherein the aperture is struck partially in all three panels. Additionally, the flap may be hingably connected to said side panel and to said second wall panel, said means comprising a cut line between said hinged connections which extends into both said side panel and second wall panel.

Specific embodiments of the invention will now be described, by way of example only, with reference to the accompanying drawings, in which.

Referring to FIGS. 1 to 5 there is shown a first embodiment of a retaining means 10 according to the invention. The retaining means 10 is formed in a side wall comprising a side panel 42 and inclined heel panel 44 and a second wall panel which in this example is lap (bottom) panel 46 of a wraparound carrier of a known type such as that disclosed in EPO171229B1. The retaining means 10 is not exclusively intended for the heel portion of an article and might be used for an upper shoulder of an article for example. The retaining means 10 can be formed at the ends of the tubular structure of a wraparound carrier for example to retain the end (corner) articles or alternatively can be provided for only any one or more of the articles held in a carrier.

Figure 2:
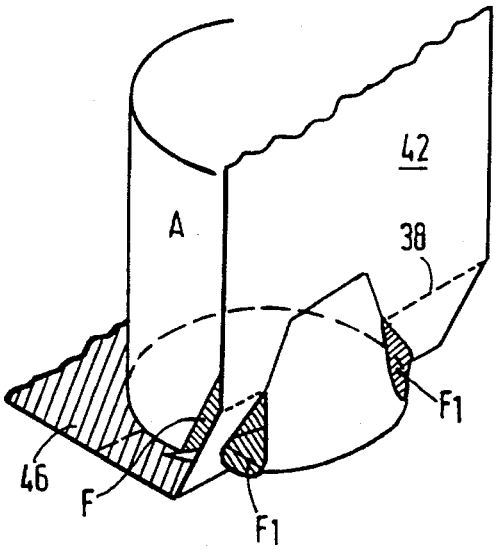
FIG. 2 is a perspective view of the retaining means shown in FIG. 1 in a formed position in engagement with a bottle A.
Figure 3:
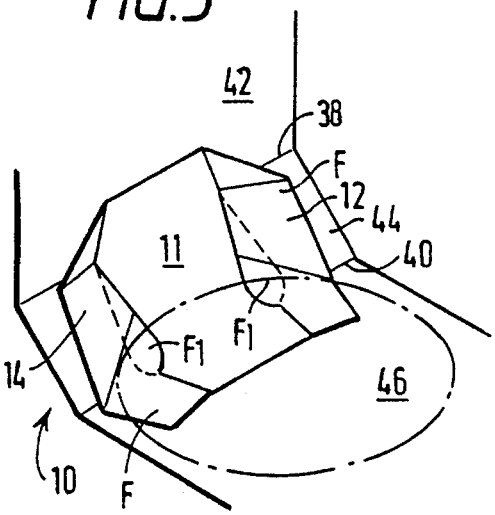
FIG. 3 is a perspective view of the arrangement shown in FIG. 2 as seen internally of the carton with the article removed.
Figure 4:
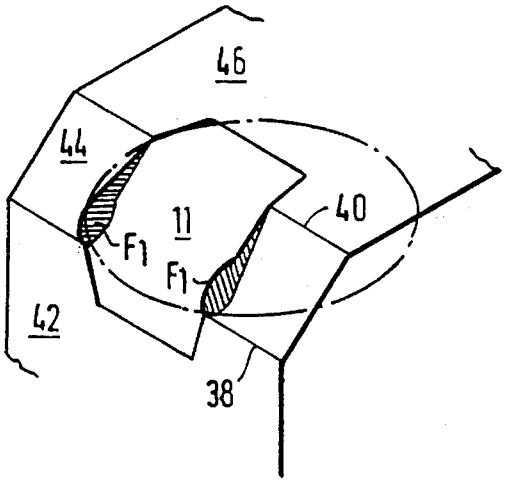
FIG. 4 is a perspective view of the arrangement shown in FIG. 3 as seen externally of the carton.

The retaining means 10 comprises a retaining aperture 11 which in this example receives the heel of a bottle A as shown in FIG. 2. The retaining means 10 also comprises retaining flaps 12 and 14 which in the formed carton provide internal flap portions F which abut that part of the heel of an article A adjacent the sloping panel 44 and external flap portions $F_1$ which engage heel portions of an article protruding externally through the aperture.

Figure 1:
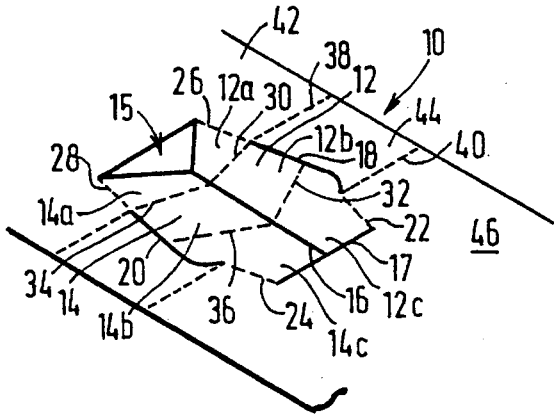
FIG. 1 is a perspective view of a retaining means according to the invention in a portion of an unformed blank.
Figure 5:
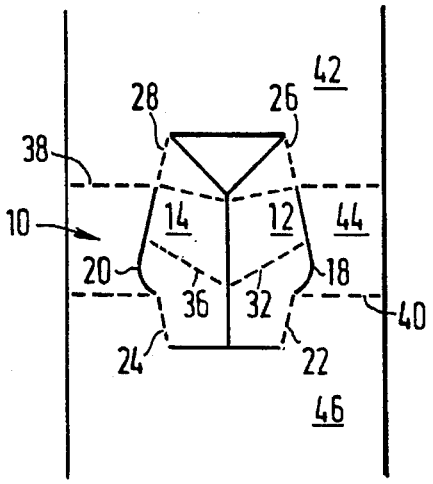
FIG. 5 is a plan view of an unformed retaining feature as shown in FIG. 1.

In more detail, retaining means 10 comprises a first flap 12 comprising upper, middle and lower flap portions 12*a*, 12*b* and 12*c* respectively. Upper portion 12*a* is hinged to side wall 42 along hinge line 26. Middle portion 12*b* is hinged to upper portion 12*a* along hinge line 30, and to lower panel portion 12*c* along hinge line 32. Lower panel portion 12*c* is hinged to lap panel 46 along hinge line 22. An arcuate cut 18 extends from hinge line 26 to hinge line 22. These hinge lines 26, 22 and cut 18 together define a lateral edge of first flap 12 as shown in FIGS. 1 and 5. First flap 12 is struck from the carton panels 42, 44 and 46 by top cut 15, central cut line 16 and bottom cut 17 and is pivotal about the hinged connections 26 and 22.

Similarly, a complementary second flap 14 comprises top, middle and bottom flap portions 14*a*, 14*b* and 14*c* respectively. In this embodiment of the invention flap 14 is the mirror image of flap 12 along the central cut line 16. Of course, they need not necessarily be mirror images and indeed only one flap might be provided in a given retaining means 10. Also, it is envisaged that where two flaps are provided they need not abut along cut line 16 and indeed a significant gap could be provided between the flaps for example. In flap 14, upper hinge line 28 connects upper flap portion 14*a* to side wall 42 and upper flap portion 14*a* is foldably connected to central panel portion 14*b* along hinge line 34. Lower portion 14*c* is hingably connected to middle flap portion 14*b* along hinge line 36 and to lap panel 46 along hinge line 24. Complementary flap 14 is pivotal about the hinged connections 28 and 24. When both flaps are coplanar, such as when the carrier is in blank form, the aperture is substantially closed.

To erect a wrap-around carrier comprising a retaining means 10 first the underside of the top of the carrier blank is applied to the tops of a group of bottles to be packaged in the carrier and the side walls folded downwardly to be disposed in flanking relationship along the side walls of the bottles. Then flaps 12 and 14 are displaced inwardly by suitable means which may be similar, at least in function, to those known for example from EPO322159B1. Displacement of flaps 12 and 14 thus, causes flap portions F to be disposed internally of the carton and flap portion $F_1$ to be disposed externally of the carton. The heel portion of a bottle A is thereby engaged in the aperture 11 and also received by the flaps 12 and 14 of retaining means 10. Lap panel 46 can then be folded upwardly into engagement with the bases of the bottles A as shown in FIG. 2. A similar operation on the opposite side of the group of articles also is performed and the wraparound carrier can be completed by securing the overlapping base panels together, for example by gluing or preferably by mechanical locks.

The structure of retaining means 10 is such that both internal and external retaining flap portions are provided to engage the heel of bottle A. The external flap portion $F_1$ helps to protect that part of the bottle A which protrudes from the carrier. The retaining flaps are particularly able to conform to the bottom portions of bottles because of their pivotal action and the bending action permitted by fold lines 30, 32 and 34, 36. Conformability of this type is enhanced by the long curved "c" cut of the types 18 and 20 shown in the first embodiment of the invention and by the double hinge mechanism provided for each flap 12 and 14. Additionally, better pack tightening can be effected by the invention due to a beneficial resistance to tear provided by the flaps 12 and 14. These flaps (or aperture doors) can act as buffers, which push against the lateral edges of the aperture 11 (or door frame) when a bottle heel is inserted in the aperture 11. The flaps 12 and 14 having both inner and outer portions can therefore act to disperse the tearing action of a bottle against the periphery of the aperture. It is apparent that a large amount of paperboard may be put into contact with a retained article using a retaining structure according to the invention, thereby providing both protection and security for the article.

Additionally, this door opening effect allows a relatively large portion of the heel portion of bottles to be inserted into aperture 11, thereby enabling a relatively strong pack tightening whilst minimising the risk of tearing. This is found to be advantageous for example in packaging petalloid bottles where a relatively large aperture is useful in locating the bottle in the carton and the flap acts to protect the relatively large amount of bottle protruding from the carton aperture. These features and benefits can possibly be better appreciated from the perspective views shown in FIGS. 3 and 4 wherein an article A has been removed leaving only a circle drawn on lap panel 46 which is representative of the base of article A. Fold lines 32 and 36 are positioned so that when flaps 12 and 14 are set up in their operative positions, lower flap portions 12*c* and 14*c* are disposed in inclined relationship above lap panel 46 beneath the base of bottle A, the fold lines 32 and 36 being above the base of the bottle. The curved side edge of bottle A is engaged by flaps 12 and 14 which act to "cup" around the heel portion of the bottle thereby retaining and bracing the bottle whilst also cushioning it against knocks.

Figure 6:
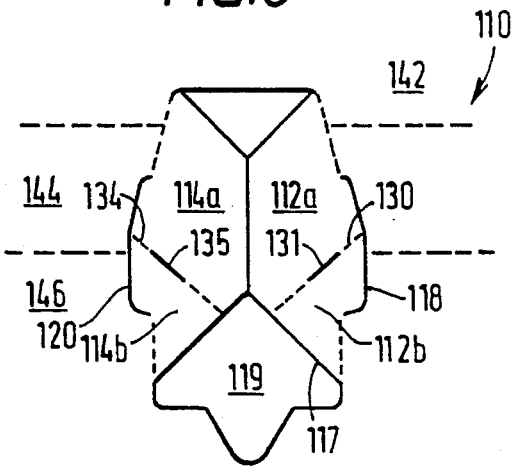
FIG. 6 is a plan view of a second embodiment of a retaining feature according to the invention.
Figure 7:
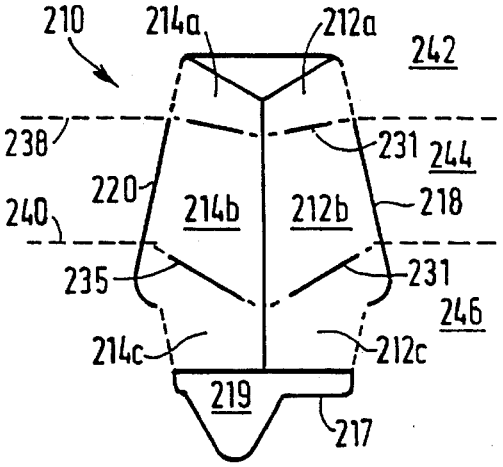
FIG. 7 is a plan view of a third embodiment of a retaining feature according to the invention.
Figure 8:
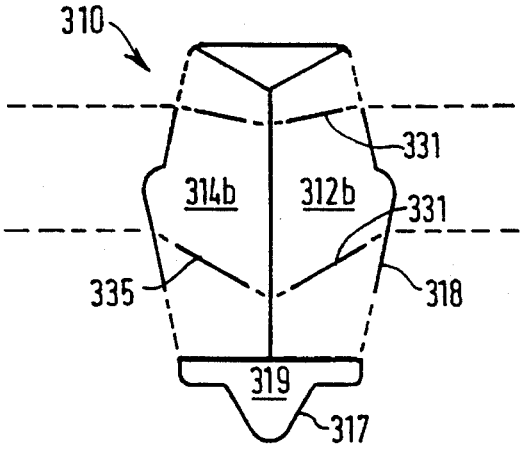
FIG. 8 is a plan view of a fourth embodiment of a retaining feature according to the invention.

Further examples of embodiments of the invention are shown in FIGS. 6, 7 and 8. These comprise substantially similar retaining means to that shown in FIGS. 1 to 5 and accordingly like elements are given like reference digits prefixed by the digit 1 for the embodiment in FIG. 6, the digit 2 for the embodiment shown in FIG. 7 and the digit 3 for the embodiment shown in FIG. 8.

In the first embodiment the fold line between upper portion 12*a* and middle portion 12*b* and between portions 14*a* and 14*b* of the flap panels 12 and 14, i.e. fold lines 30 and 34, are both co-terminus with interrupted fold line 38 at the outer lateral edges of flaps 12 and 14. The cut lines 18 and 20 extend in the sloping panel 44 between fold lines 38 and 40. In the embodiment shown in FIG. 6 no such fold line exists. Accordingly, flaps 112 and 114 comprise only upper portions 112*a* and 114*a* respectively and bottom panels 112*b* and 114*b* respectively.

Lateral cut lines 118 and 120 are differently shaped to cut lines 18 and 20 of the first embodiment, and therefore provide a different shape of flap F on the exterior of the carrier. In this embodiment the cuts 118 and 120 extend from within the inclined heel panel 144 into the lap panel 146. Additionally, fold line 130 and 134 between portions of the flap panels 112 and 114 are interrupted by cuts 131 and 135 respectively. These cuts are found to assist in the folding of the flap panel portions relative to one another.

With regard to FIG. 7 there is shown a third embodiment of a retaining feature 210 according to the invention. Retaining feature 210 comprises lateral cuts 218 and 220 which extend from the interrupted hinge line 238 between the side wall 242 and inclined heel panel 244, into the lap panel 246. Again, cuts 231 and 235 are provided along the fold lines between portions of the main flap panels 212 and 214.

Additionally, in common with the embodiment shown in FIG. 6 and cut 117 thereof, the bottom cut 217 which defines the bottom of the main flaps 212 and 214, defines an aperture 219 in lap panel 246. This aperture is visible in the unformed condition of retention means 210 as shown in FIG. 7 and forms part of aperture 211 in the formed condition. Similarly, bottom cut ill defines an aperture 119, and in the fourth embodiment shown in FIG. 8 bottom cut 317 defines an aperture 319. These apertures in the lap panels 146, 246 and 346 can be used to push two lap panels together before and during the step of securing the lap panels together in forming the carrier.

Finally, the fourth embodiment shown in FIG. 8 is substantially similar to the embodiment shown in FIG. 7 except that lateral cuts 318 and 320 are of a more elaborate shape thereby providing a differently shaped aperture 311 to 211 and hence outwardly extending flap portion $F_1$.

It should be noted that in all the embodiments shown a "double hinge" mechanism is provided for each of the main flap portions of the retaining means. This is found to be a benefit in enabling the formation of an outwardly protruding flap portion $F_1$ and also in providing a flexible buffer or brace against which the heel of an article or bottle can abut without tearing the carton walls surrounding the retaining features. However, an aspect of the invention is not limited to such a configuration and it is envisaged that it would be possible to provide a retaining means according to the invention comprising one or more hinge means per retaining flap in order to enable a protruding flap portion $F_1$ to be provided in the assembled carrier. Also, it is envisaged that when two hinges are provided for each flap they might connect the flap to a side and inclined panel of a carton, or a bottom and inclined panel, or a side and bottom panel for example. In all these constructions however the external flap portion $F_1$ is put into its operative position by displacing the retaining flap portion F internally of the carton out of the plane of the associated retaining aperture.

We claim:

1. An article carrier comprising a plurality of interconnected panels, including a side wall panel and a second wall panel which are foldably interconnected, article receiving and retaining means extending between said side wall panel and said second wall panel, said means comprising an aperture adapted to receive a portion of an article contained within the carrier, and a flap struck from and hingably connected to an edge of said aperture which flap is adapted to abut the article received in the aperture, and wherein the flap is pivotal into an operative position about its hinged connection to provide portions thereof which protrude both inwardly and outwardly of the carrier so that a portion of said flap engages the article internally of the carrier and another portion of said flap engages the article externally of the carrier, said flap being put into its operative position by pivoting inwardly of the carrier.

2. An article carrier according to claim 1 wherein said second wall panel is a top wall panel.

3. An article carrier according to claim 1 wherein said second wall panel is a bottom wall panel.

4. An article carrier according to claim 1 wherein said receiving and retaining means comprises a pair of complimentary hinged flaps, each being hinged on opposite edges of said aperture.

5. An article carrier according to claim 4 wherein each of said flaps includes an upper portion and a lower portion hinged so as to be foldable relative to one another and thereby allow the flap to bend and conform to the shape of an adjacent portion of an article and wherein the hinged connection between said upper and lower flap portions is disposed above the base of an article engaged therewith.

6. A blank for forming an article carrier according to claim 1.

7. An article carrier according to claim 1 wherein said other portion of the flap is defined at least in part by a cut line extending between a pair of spaced hinged connections about which the flap is pivoted inwardly of tile carrier.

8. An article carrier according to claim 7 wherein said other portion of the flap is disposed laterally beyond an imaginary straight line taken between adjacent ends of the hinged connections.

9. An article carrier according to claim 7 which further comprises an inclined panel which foldably connects together said side panel and the second wall panel of the carrier and wherein said aperture is struck partially from each of said side panel, said inclined panel and said second wall panel.

10. An article carrier according to claim 9 wherein said cut line is formed in said inclined panel between the first and second hinges of the flap which hinges are formed in the side and second panels respectively.

11. An article carrier according to claim 9 wherein said cut line is formed partially in said inclined panel and partially in said second wall panel between the first and second hinges which hinges are formed at least partially in said side panel and in said second wall panel respectively.

12. An article carrier according to claim 7 wherein the cut between the first and second hinges of the flaps is substantially arcuate.

13. An article carrier according to claim 1 wherein an article carrier receiving means is provided to receive each of the outermost corner articles contained in the carrier.

14. An article carrier having top, bottom and side walls interconnected to form a tubular open-ended structure, a sloping heel panel interconnected with each side wall along a fold line and an associated bottom lap panel along a fold line and article heel receiving and retaining means comprising apertures formed in each sloping heel panel which extend into the associated side wall and bottom lap panel, said receiving means including article engaging and carrier reinforcing flaps which are foldably joined to said lap panel and said side wall panel, said flaps having fold lines formed therein which allow the flaps to conform to the configuration of the article and wherein, in the formed carrier, the flaps are folded substantially inwardly but also provide an outwardly extending portion which abuts that part of the article protruding through the associated receiving aperture.

15. An article carrier having an article receiving and retaining means struck from corner panels in adjacent walls of the carrier, said article receiving and retaining means comprising an aperture within the corner panels and a flap struck from and hingably connected to an edge of the aperture which flap is adapted to pivot into an operative position about its hinge to provide portions thereof which extend both inwardly and outwardly of the carrier, both inwardly and outwardly extending portions being adapted to engage respective parts of an article received in the aperture, said flap being adapted to be put into said operative position by pivoting said operatively inwardly extending flap portion inwardly.

16. An article carrier according to claim 15 wherein the flap comprises a series of foldably interconnected flap portions, at least one portion of which is adapted at least partially to engage an end of an article in use and at least an adjacent flap portion is adapted to engage a side of an article in use, wherein the fold line between the one and adjacent flap portions is disposed adjacent the side of the article in use.

17. A blank for forming an article carrier, comprising a plurality of interconnected panels, including a side wall panel and a second wall panel which are foldably interconnected, article receiving and retaining means extending between a side wall panel and said second wall panel, said means comprising an aperture adapted to receive a portion of an article when the blank is erected into said article carrier and a flap struck from and hingably connected to an edge of said aperture which flap is adapted to abut the article received in the aperture, wherein the flap is adapted to pivot into an operative position about its hinged connection to provide portions thereof which extend both inwardly and outwardly through the aperture when the blank is erected into said article carrier, a portion of said flap being adapted to engage part of an article internally of the carrier and another portion of said flap being adapted to engage part of the article externally of the carrier, said flap being put into its operative position by pivoting inwardly of the carrier.

18. A blank according to claim 17 wherein said side wall panel comprises a side panel and an inclined panel which inclined panel foldably connects together the side panel and the second wall panel, and wherein the aperture is struck partially in all three panels.

19. A blank according to claim 18 wherein said flap is hingably connected to said side panel and to said second wall panel, said means comprising a cut line between said hinged connections which extends into both said side panel and said second wall panel.

* * * * *